US005724674A

United States Patent [19]

Covington et al.

[11] Patent Number: 5,724,674

[45] Date of Patent: Mar. 10, 1998

[54] REINFORCED SLEEVE FOR SURGICAL GOWN

[75] Inventors: David Loring Covington, Cumming; David James Alexander, Alpharetta, both of Ga.

[73] Assignee: Kimberly-Clark Corporation, Neenah, Wis.

[21] Appl. No.: 671,272

[22] Filed: Jun. 27, 1996

Related U.S. Application Data

[63] Continuation of Ser. No. 286,038, Aug. 4, 1994, abandoned.

[51] Int. Cl.[6] ..... A41D 13/00; A41D 13/08; A41D 13/12; A41D 27/10

[52] U.S. Cl. ..... 2/114; 2/59; 2/125; 2/275; 2/243.1

[58] Field of Search ..... 2/46, 50, 51, 52, 2/59, 69, 69.8, 104, 105, 106, 113, 114, 115, 125, 126, 275, 240, 243.1

[56] References Cited

U.S. PATENT DOCUMENTS

| | | | |
|---|---|---|---|
| 1,344,011 | 6/1920 | Whitaker | 2/59 |
| 2,309,601 | 1/1943 | Kneubler | 2/125 X |
| 2,605,582 | 8/1952 | Allen | 2/59 |
| 2,632,165 | 3/1953 | Murdock | 2/275 |
| 3,038,167 | 6/1962 | Rajki | 2/275 |
| 3,078,467 | 2/1963 | Artzt | 2/114 X |
| 3,359,569 | 12/1967 | Rotanz et al. | 2/114 |
| 3,727,239 | 4/1973 | Thompson | 2/123 |
| 3,868,728 | 3/1975 | Krewinski | 2/114 |
| 4,017,909 | 4/1977 | Brandiff | 2/114 |
| 4,041,203 | 8/1977 | Brock et al. | 428/157 |
| 4,389,734 | 6/1983 | Franz et al. | 2/59 |
| 4,504,977 | 3/1985 | King et al. | 2/51 |
| 4,504,978 | 3/1985 | Gregory, Jr. et al. | 2/59 |
| 4,586,196 | 5/1986 | White | 2/114 |
| 4,587,671 | 5/1986 | Rodriguez, Jr. et al. | 2/69 |
| 4,783,854 | 11/1988 | Bjorklund | 2/114 X |
| 4,829,602 | 5/1989 | Harreld et al. | 2/51 |
| 4,852,187 | 8/1989 | Johansson | 2/69 |
| 4,991,232 | 2/1991 | Taylor | 2/51 |
| 4,996,722 | 3/1991 | Jimenez et al. | 2/51 |
| 5,025,501 | 6/1991 | Dillon | 2/51 |
| 5,062,160 | 11/1991 | Dillon, Jr. | 2/114 |
| 5,093,934 | 3/1992 | Dillon, Jr. | 2/243 |

FOREIGN PATENT DOCUMENTS

| | | | |
|---|---|---|---|
| 1460071 | 2/1969 | Germany | 2/275 |

*Primary Examiner*—Jeanette E. Chapman
*Attorney, Agent, or Firm*—Jones & Askew

[57] ABSTRACT

Improved material utilization and barrier protection for surgical sleeves is provided by improved garment pattern design and methods of assembly. The surgical sleeve of the present invention is formed from a single sheet of material. By folding the sheet of material, a reinforcing layer integral with a sleeve layer is formed. A dual layered sleeve having two integral sleeve layers is also formed by folding a single sheet of material. One of the sleeve layers of the dual layered sleeve may be folded so as to form a reinforcing layer integral with said sleeve layer.

12 Claims, 9 Drawing Sheets

REINFORCED SLEEVE FOR SURGICAL GOWN

This is a continuation of application Ser. No. 08/286,038 filed Aug. 4, 1994, now abandoned.

FIELD OF THE INVENTION

This invention relates to gowns and other garments and particularly to surgical gowns and methods for making the same. More particularly, this invention relates to improved gown sleeves and improved gown assembly techniques, the use thereof providing both improved barrier protection and improved material utilization.

BACKGROUND OF THE INVENTION

As is generally known, sterile surgical gowns are designed to greatly reduce, if not prevent, the transmission through the gown of liquids and biological contaminates which may become entrained therein. In surgical procedure environments, such liquids sources include the gown wearer's perspiration, patient liquids, such as blood and life support liquids such as plasma and saline.

Surgical gowns were originally made of cotton or linen and were sterilized prior to their use in the operating room. These gowns, however, permitted transmission or "strike-through" of various liquids encountered in surgical procedures. In these instances, a path was established for transmission of bacteria to and from the wearer of the gown. Additionally, as these gowns were costly, laundering and sterilization procedures were required before reuse.

Disposable surgical gowns have largely replaced linen surgical gowns. Because many surgical procedures require total liquid repellency to prevent strike-through, disposable gowns for use under these conditions are made entirely from liquid repellent or impervious fabrics. However, there are many surgical procedures which may permit the use of surgical gowns which are not totally liquid impervious. In these instances, disposable gowns which are not totally liquid impervious are made with such liquid repellent or impervious fabrics selectively positioned so as to provide the wearer with strike-through protection in the areas of the gown most likely to contact or be contacted by liquids. These areas include the chest and torso portions as well as the sleeve area between the elbow and wrist. Such partial liquid impervious gowns provide greater breathability and wearer comfort.

In addition to the above, and notwithstanding the degree to which a surgical gown is liquid impervious, it is sometimes desirable to reinforce selected portions of the gown. Generally, these reinforced areas may also be the areas most likely to encounter abrasive contact or be contacted by liquids. Such areas include, for example, the chest, torso and sleeve areas. Reinforcement in these areas provides improved resistance to abrasion and strike-through.

Whether the surgical gown is disposable or reusable, liquid impervious or partially liquid impervious or whether the gown is reinforced or non-reinforced, reducing manufacturing costs and material wastage benefit both suppliers and manufactures of such gowns as well as purchasers and society at large.

SUMMARY OF THE INVENTION

The present invention relates to surgical gowns and particularly to disposable surgical gowns having a body and a sleeve secured to the body. The sleeve includes at least two integral layers. One of these layers forms the sleeve and the other layer forms a reinforcing layer adapted to substantially encircle a portion of the wearer's arm.

In another embodiment, the gown sleeve is a dual layered sleeve and includes at least two integral sleeve layers wherein at least two of the layers each extend the length of the sleeve.

In another embodiment, the gown sleeve includes at least two integral sleeve layers wherein at least two of these layers extend the length of the sleeve. One of said layers includes a reinforced area. The reinforced area includes at least two integral layers.

In another embodiment, the surgical gown is formed from a garment blank which includes portions thereof defining a body integral with a sleeve. The sleeve includes a reinforced area. The reinforced area includes at least two integral layers. One of these layers forms the sleeve and the another layer forms a reinforcing layer adapted to substantially encircle a portion of a wearer's arm.

BRIEF DESCRIPTION OF THE DRAWINGS

FIGS. 19 A and B is a plan view of a partially formed dual-layered sleeve of the pattern of FIG. 19.

DETAILED DESCRIPTION OF THE INVENTION

Several terms may be used herein to refer to various parts of the gown as the gown is worn. Thus, "front" refers to that part of the gown which overlays the chest or anterior plane of the wearer; "back" or "rear" refers to that part of the gown which overlays the back or posterior plane of the wearer; "side" or "sides" refer to that part of the gown which overlays the side or lateral portion(s) of the wearer and which may extend to and overlap the back or front portions of the wearer and are generally located between the front and the back.

The term "integral" with reference to certain structures, such as in the context, "a first article is integral with a second article", means that these structures are formed from a single piece of material and that each article is defined, at least in part, by a common edge or common portion of said single piece of material. The term "integral layers" means layers formed from a sheet of material to form a two layered structure, such as by folding said sheet of material, wherein the resulting layers are defined, at least in part, by a common edge. Two or more layers or structures formed from separate or disconnected sheets of material are not "integral", "integral layers" or "integral structures". However, a sheet of material formed by joining separate sheets of material may be so oriented, such as by folding, so as to form at least two layers defined by a common edge and as such would be "integral layers".

Additionally, several terms are used herein to refer to affixing one part of the gown to another part. These terms include "bond", "join", "secure", "attach" and derivatives and synonyms thereof. The affixing of these pieces of gown parts to one another may be accomplished by several conventional methods. By way of example and not limitation, these methods include stitching, gluing, heat sealing, zipping, snapping, sonic or thermal bonding, ultrasonic sealing or using a hook and loop fastening system and other methods familiar to those skilled in the art.

Figure 1:
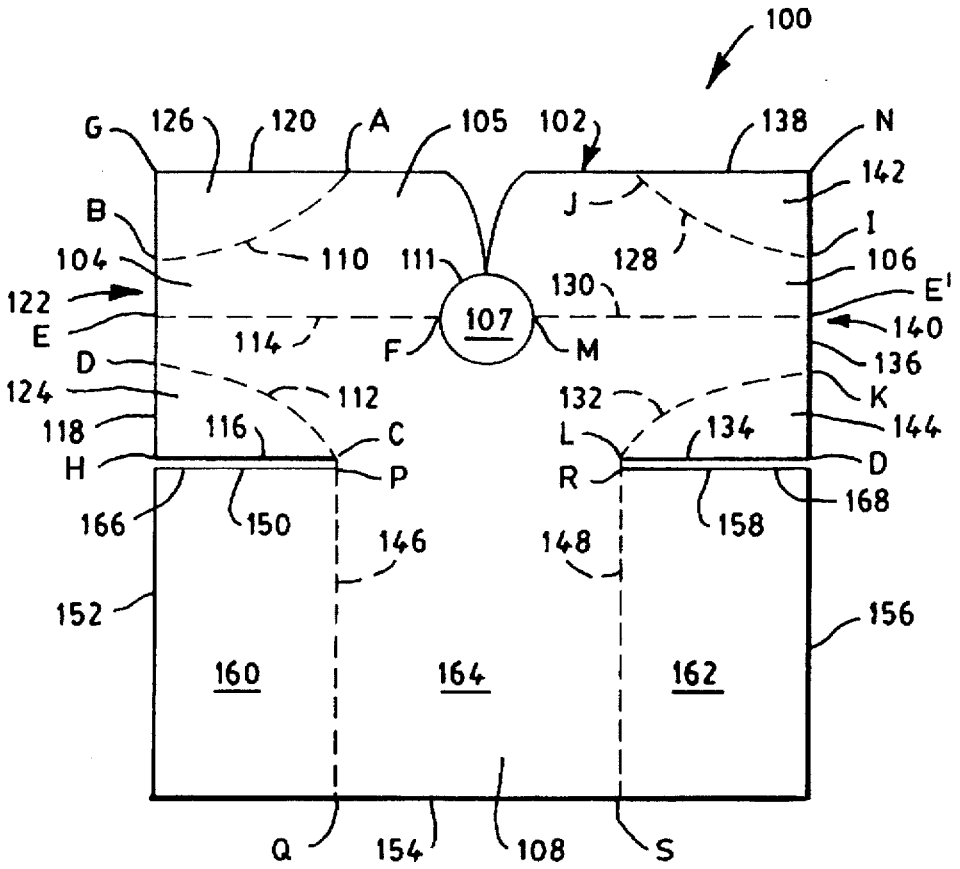
FIG. 1 is a plan view of a single sheet garment blank illustrating a gown pattern.

Turning now to the drawings and referring first to FIG. 1, disclosed therein is a garment blank 100 upon which a gown pattern 102 is illustrated. The gown pattern 102 includes a pair of-sleeve patterns 104 and 106 and a shoulder pattern 105, a body pattern 108 and a neck opening 107 defined by edge 111.

The sleeve pattern 104 is defined by fold lines 110, 112 and 114 as well as by edges 116 and 118 and a portion of edge 120 of the garment blank 100. The fold line 110 extends from a point A on the edge 120 to the edge 118, intersecting the edge 118 at point B. The fold line 112 extends from a point C on the edge 116 to the edge 118, intersecting the edge 118 at point D. The fold line 114 extends from a point E on the edge 118 and terminates at a point F on the edge 111. Furthermore, it will be noted that the edges 118 and 116 intersect at point H and edges 118 and 120 intersect at point G.

A sleeve layer 122 is defined by a portion of the sleeve pattern 104 bounded by the fold lines 112 and 110 and a line D-B and a line A-C (not shown). A pair 0f generally triangular-shaped reinforcing layers or wings, 124 and 126, are also defined by portions of the sleeve pattern 104. The reinforcing layer 124 is defined by the fold line 112 and the edges defining the angle CHD. The reinforcing layer 126 is defined by the fold line 110 and the edges defining the angle AGB. As the reinforcing layers 124 and 126 each share a common edge or border with the sleeve layer 122, the reinforcing layers 124 and 126 are integral with the sleeve layer 122.

The sleeve pattern 106 is similar to the sleeve pattern 104. The sleeve pattern 106 is defined by fold lines 128, 130 and 132 as well as by edges 134 and 136 and a portion of edge 138. The fold line 128 extends between points I and J and the fold line 132 extends between points K and L. The fold line 130 extends from a point E' on the edge 136 to a point M on the edge 111. Additionally, the edges 138 and 136 intersect at point N and the edges 134 and 136 intersect at point O.

Another sleeve layer 140 is defined by a portion of the sleeve pattern 106 bounded by the fold lines 128 and 132 and lines J-L (not shown) and I-K. Another pair of triangular-shaped reinforcing layers or wings, 142 and 144 is also defined by portions of the sleeve pattern 106. The reinforcing layer 142 is defined by the fold line 128 and the edges forming the angle JNI. The reinforcing layer 144 is defined by the fold line 132 and the edges forming the angle LOK. As the reinforcing layers 142 and 144 each share a common edge or border with the sleeve layer 140, the reinforcing layers 142 and 144 are integral with the sleeve layer 140.

Interconnecting the two sleeve patterns 104 and 106 is the shoulder pattern 105. The shoulder pattern is defined generally by a portion of the garment blank 100 bounded by and within lines A-C, C-L and L-J (all not shown).

The gown pattern 102 further includes a pair of fold lines 146 and 148 and edges 150, 152, 154, 156 and 158. The fold line 146 extends from a point P on the edge 150 to a point Q on the edge 154. The fold line 148 extends from a point R on the edge 158 to a point S on the edge 154. In this way, a rear back panel 160 is defined by the fold line 146 and the edges 150 and 152 and a portion of the edge 154 between the point Q and the edge 152. Another rear back panel 162 is defined by the fold line 148 and the edges 158 and 156 and a portion of the edge 154 between the point S and the edge 156. A front panel is defined by the lines P-L (not shown), P-Q, Q-S and S-L.

It will be noted that the sleeve patterns 104 and 106 have been separated from the rear panels 160 and 162 by slits 166 and 168, respectively. As illustrated in FIG. 1, the slit 166 is defined by edges 116 and 150 and the slit 168 is defined by edges 134 and 158.

Figure 2:
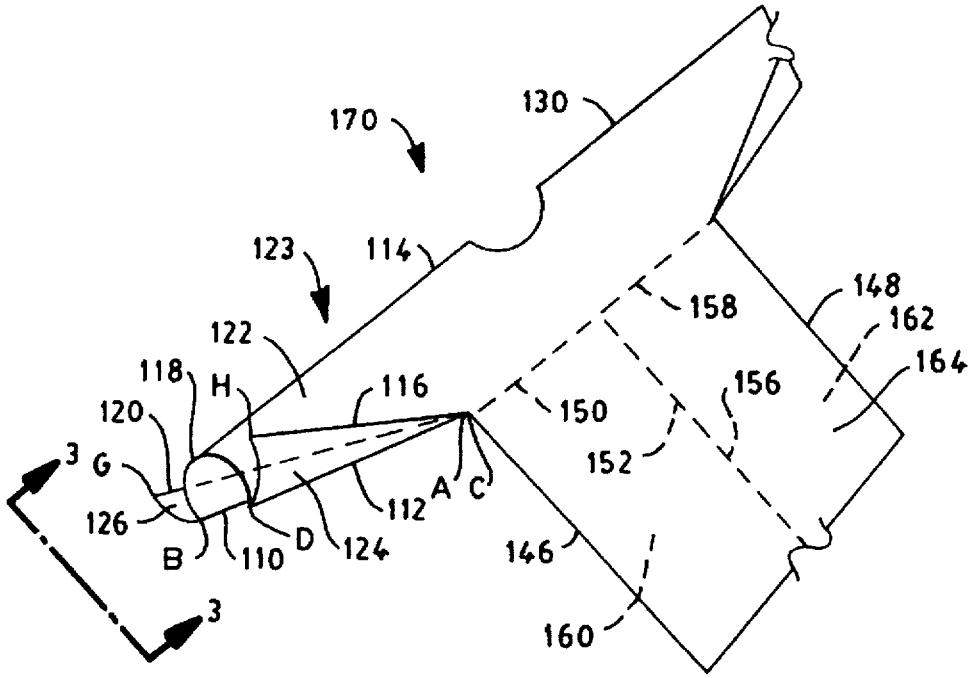
FIG. 2 is an isometric view of a partially formed gown according to the pattern of FIG. 1, and further illustrating a pair of sleeve reinforcing layers integral with material forming the sleeve.

Folding portions of the garment blank 100 about the various fold lines, FIG. 2 now more clearly illustrates the formation of a gown 170 (partially illustrated) from the gown pattern 102. The gown 170 is formed by folding the garment blank 100 about the fold lines 114, 130, 146 and 148. In this way, the portions 0f the garment blank 100 above the fold lines 114 and 130 lay under the garment blank 100. Similarly, the rear panels 160 and 162 are folded about the fold lines 146 and 148, respectively, such that the rear panels 160 and 162 lay under by the front panel 164.

Figure 3:
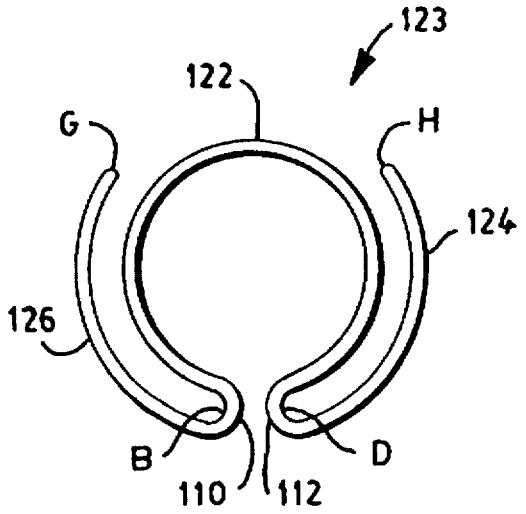
FIG. 3 is a view of the sleeve of FIG. 2 taken along lines 3—3 of FIG. 2.

The folding sequence of the sleeve patterns 104 and 106 are essentially the same. For ease of convenience, the folding sequence of the sleeve pattern 104 will be described. Referring now to FIG. 2, a sleeve 123 is formed by outwardly folding the reinforcing layers 124 and 126 about the respective fold lines 112 and 110. In this way, the reinforcing layers 124 and 126 are positioned outboard from an exterior surface of the gown and in juxtaposed orientation with the sleeve layer 122. The orientation of the reinforcing layers 124 and 126 to the partially assembled sleeve 123 is more clearly illustrated in FIG.3. It will be understood that the reinforcing layers 124 and 126 may also be inwardly folded or alternately folded, such as for example, one of the reinforcing layers may be positioned inward of the sleeve layer and another reinforcing layer may be positioned outward of the sleeve layer. (FIGS. 6 and 7) Upon folding the sleeve pattern 104, as illustrated in FIGS. 2 and 3, a ventral seam 171 is formed by bonding the edges defined by the fold lines 110 and 112, as illustrated in FIG. 4.

Figure 4:
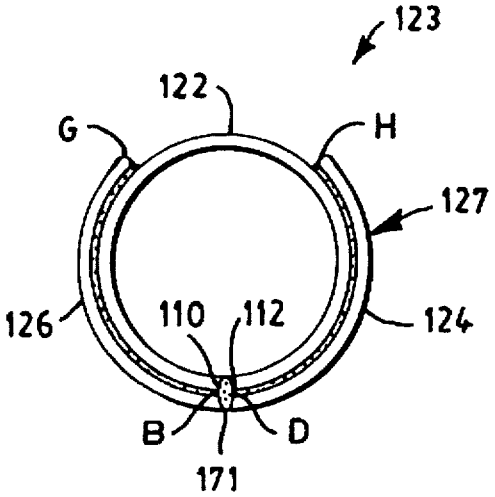
FIG. 4 is similar to the view of FIG. 3 and further illustrates the bonding between the sleeve and the pair of juxtaposed sleeve reinforcing layers.
Figure 5:
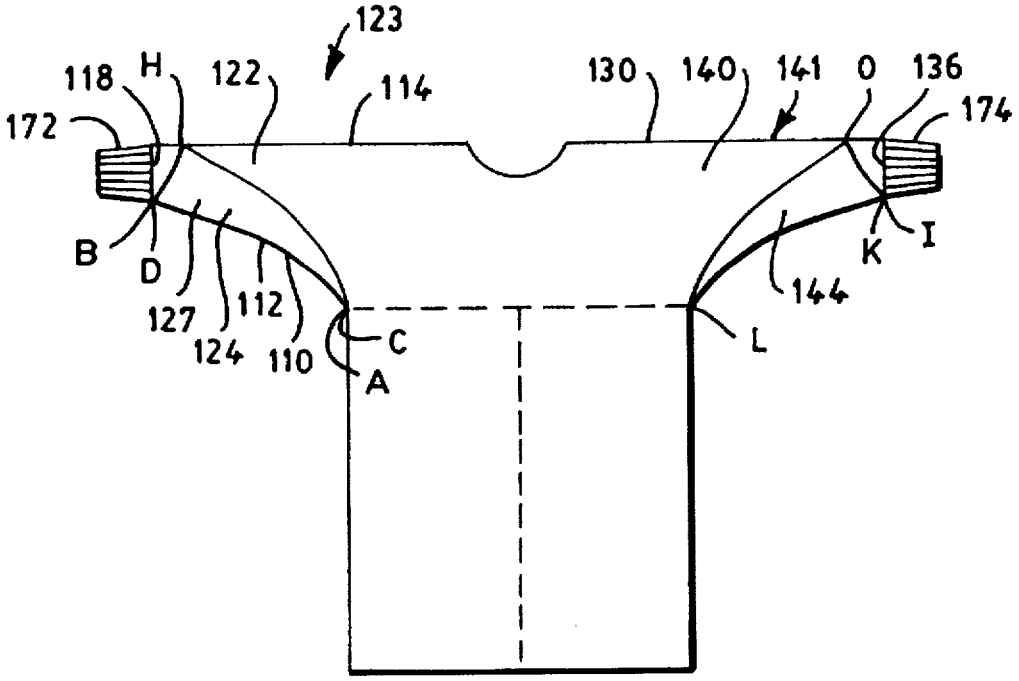
FIG. 5 is a plan view of a gown formed according to the pattern of FIG. 1.

With continued reference to FIGS. 4 and 5, the reinforcing layers 126 and 124 are secured to the sleeve layer 122. In one embodiment, substantially the entire surface of the reinforcing layers 126 and 124 may be bonded to the adjacent surfaces of the sleeve layer 122. In another embodiment, portions of said surfaces of the reinforcing layers 126 and 124 may be bonded to the surface of the sleeve layer 122. Once secured to the sleeve layer 122, a portion of the reinforcing layers 126 and 124 substantially encircle or overlay a portion of the sleeve layer 122. More particularly, the sleeve layer 122 is encircled or overlaid to a greater extent by the portions of the reinforcing layer 126 around point G and the reinforcing layer 124 around point H than the portion of the reinforcing layers 126 and 124 around points A and C, respectively (FIGS. 4 and 5). In this way, the width or coverage area of a generally diamond-shaped reinforcing area 127, defined by the layers 126 and 124 in juxtaposed orientation where the sleeve layer 122, generally decreases from about the wearer's wrist through the length of the sleeve.

Furthermore, it will be noted that the reinforcing area 127 overlies a greater portion of the bottom side of the sleeve 123 than the top side of the sleeve 123. During surgical procedures, it is generally the bottom portions of the sleeves, and more particularly, the bottom portions of the sleeves around the wearer's forearm and elbow, which come in contact with liquids as surgical personnel lean or press upon a surface with their arms.

FIG. 5 further illustrates a pair of cuffs, 172 and 174, which may be formed from an expandable material, secured to the sleeve 123. The cuff 172 is secured to the sleeve 123 about the edge 118 defined between points B and D. The cuff 174 is secured to a sleeve 141 about the edge 136 defined between points K and I. The sleeve 141 is formed in a similar fashion as the sleeve 123. Generally, the sleeves 123 and 141 are sized to cover a wearer's arm (not shown) and extend from the wearer's wrist to the wearer's shoulder (not shown).

Figure 6:
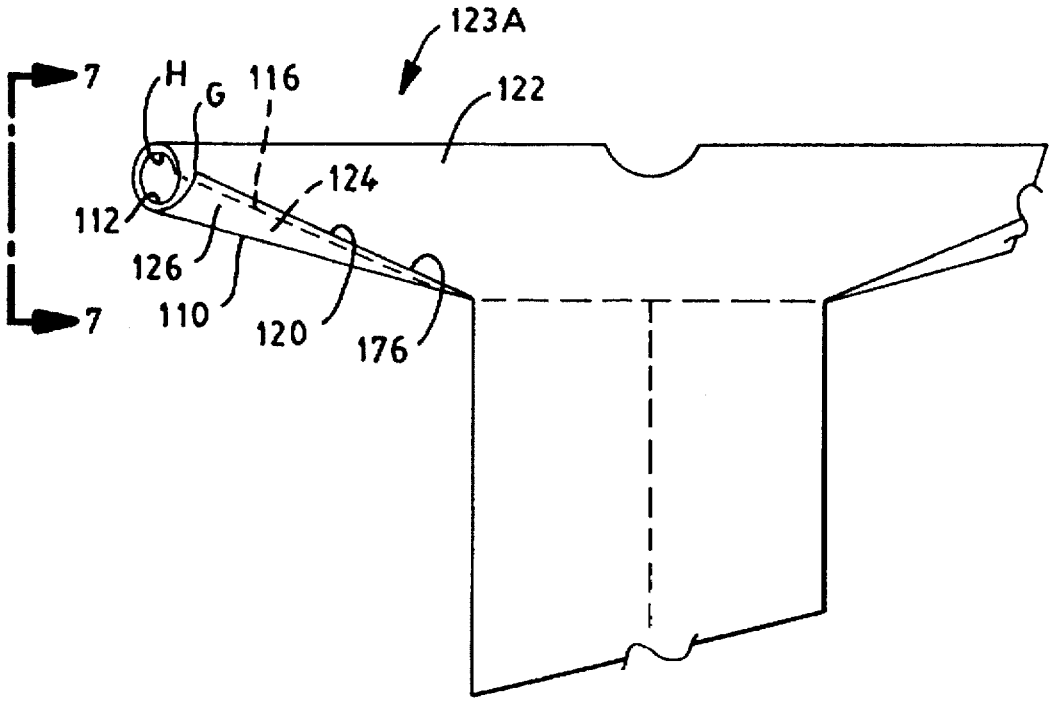
FIG. 6 is an isometric view of a partially formed gown according to the pattern of FIG. 1, and further illustrating another sleeve embodiment.
Figure 7:
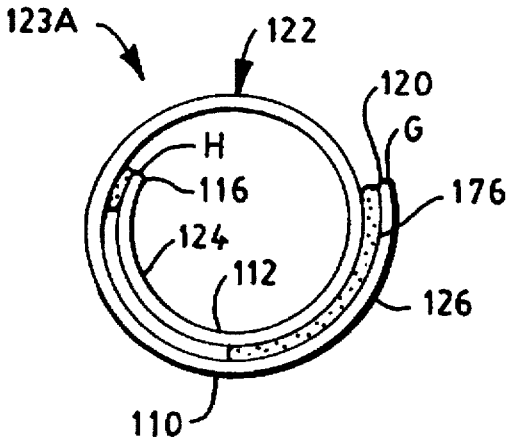
FIG. 7 is a view of the sleeve of FIG. 6 taken along lines 7—7.

FIGS. 6 and 7 illustrate an alternate embodiment of the present invention. Here, the reinforcing layer 124 is folded along the fold line 112 such that the reinforcing layer 124 is inboard or tucked into the sleeve layer 122. The reinforcing layer 126 is folded along the fold line 110 such that the reinforcing layer 126 is outboard of the sleeve layer 122. In one embodiment, the reinforcing layer 124 may be secured to the inboard surface of the sleeve layer 122 at discrete locations. Substantially the entire length of the portion of the edge 120 defining the reinforcing layer 126 may be secured to the outboard surface of the sleeve layer 122. In this way, a curved or helical seam 176 is formed in the sleeve 123A. As such, liquids contacting the top portion of the sleeve 123A are substantially prevented from entering the space between the reinforcing layers 126 and 124. Additionally, unlike the bottom seam 171 formed by bonding edges 110 and 112 (FIGS. 4 and 5) which generally extends from the bottom area of the wearer's wrist to the bottom area of the wearer's upper arm, the sleeve 123A, illustrated in FIGS. 6 and 7, is formed generally without a bottom seam in the area of the wearer's forearm and elbow. The absence of such a bottom seam in these areas provides the wearer greater comfort and protection against strike through in the forearm and elbow areas.

Figure 8:
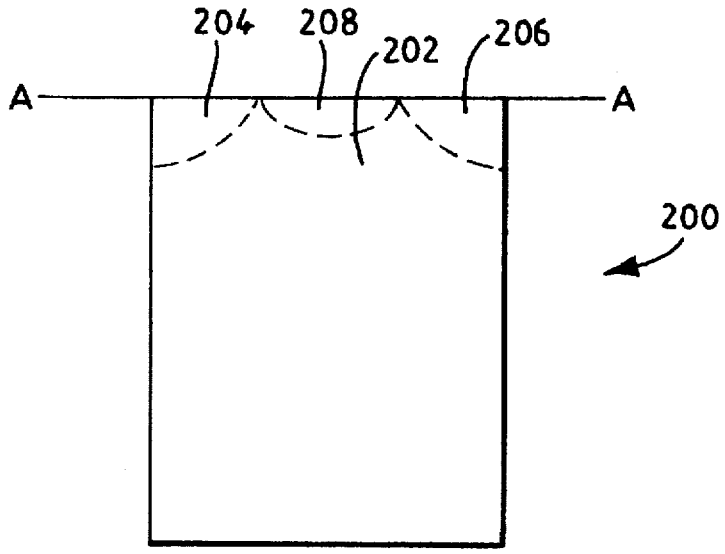
FIG. 8 is a plan view of a garment blank folded along lines A—A and illustrating a gown body pattern.

Turning now to FIG. 8, a garment blank 200, illustrating a gown body pattern 202, is folded along lines A—A. The gown pattern 202 includes a pair of sleeve opening cut-outs 204 and 206 and a neck opening cut-out 208.

Figure 9:
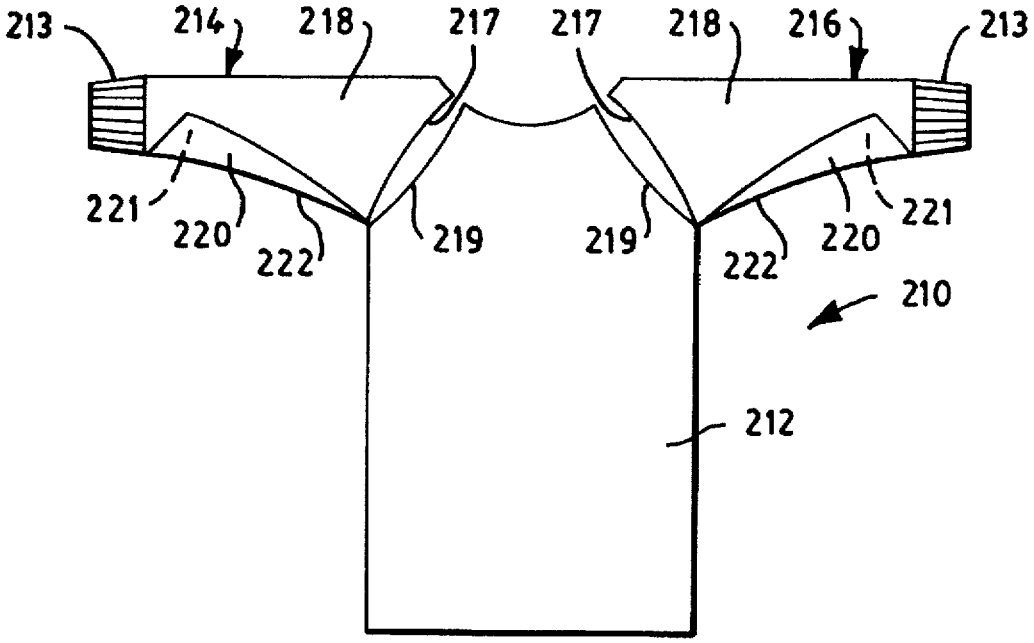
FIG. 9 is a plan view of an exploded gown illustrating the orientation of a pair of sleeves to the respective sleeve openings of the gown body formed from the pattern illustrated in FIG. 8. The sleeves and the gown body are similar to the sleeves and gown body illustrated in FIGS. 1–7 except that the sleeves and the gown body are formed from separate material.

FIG. 9 illustrates a partially assembled gown 210. A gown body 212 is formed from the garment blank 200 by removing the sleeve and neck opening cut outs, 204, 206 and 208, respectively. The gown sleeves, 214 and 216, may, as desired, be similar to the sleeves 123, 123A and 141 illustrated in FIGS. 1–7 both in shape and in the method of formation, except that sleeves 214 and 216 are not integral with the gown body 212. The sleeves 214 and 216 are formed separately and are of a raglan sleeve design.

Figure 11:
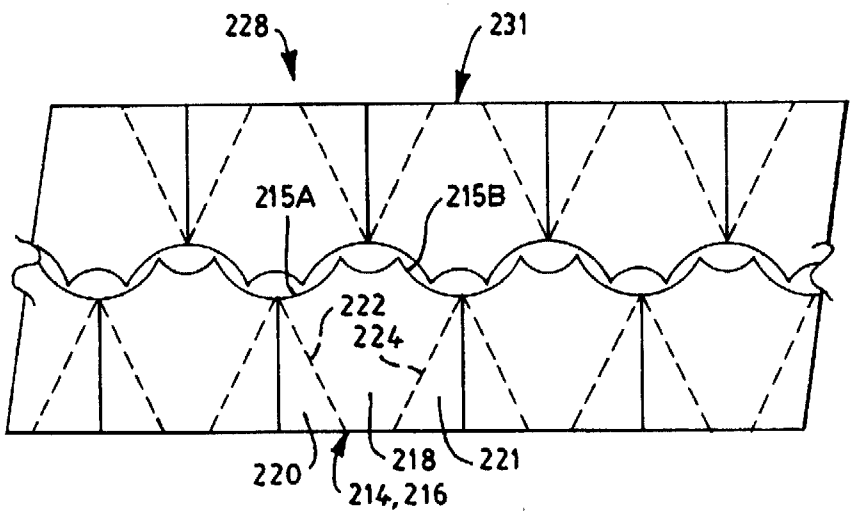
FIG. 11 is a plan view of a garment blank illustrating a repeating raglan sleeve pattern.

Referring to FIG. 11, each sleeve, 214 and 216, has a pair of edges 215A and 215B which defines a sleeve opening 217. The sleeves 214 and 216 are attached to the gown body 212 about respective openings 219 in the gown body 212. The openings 219 are formed by removing the sleeve opening cut outs 204 and 206.

Both sleeves 214 and 216 each include a cuff 213, a sleeve layer 218 and two reinforcing layers 220 and 221. The cuff 213 is attached to the distal end of the sleeve layer 218. The sleeve layer 218 is integral with the reinforcing layer 220 and 221, as both reinforcing layers, 220 and 221, share common edges or fold lines 222 and 224 (FIG. 11), respectively, with the sleeve layer 218.

Figure 10:
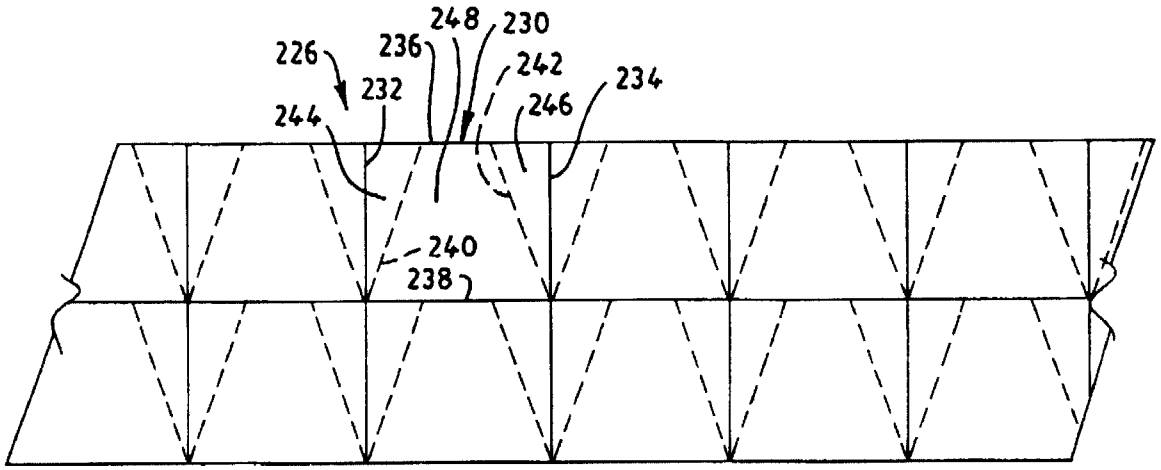
FIG. 10 is a plan view of a garment blank illustrating a repeating set-in sleeve pattern.

FIGS. 10 and 11 illustrate garment blanks 226 and 228, respectively and further illustrate the efficient utilization of material provided by the sleeve patterns of the present invention. Both of the garment blanks 226 and 228 are provided with a repeating sleeve pattern 230 and 231, respectively. The sleeve pattern 231 forms the raglan sleeves 214 and 216 described above and illustrated in FIG. 9. The sleeve pattern 230 forms a set-in sleeve.

With reference to FIG. 10, the pattern 230 is generally rectangular in shape and includes two pairs of generally parallel edges. The first pair of edges is identified by reference numerals 232 and 234. The second pair of edges is identified by reference numerals 236 and 238. A pair of fold lines 240 and 242 is also provided. A triangular reinforcing layer 244 is generally defined by the edge 232, the fold line 240 and a portion of the edge 236. Another triangular reinforcing layer 246 is generally defined by the edge 234, the fold line 242 and a portion of the edge 236. A sleeve layer 248 is generally define by the fold lines 240 and 242, the edge 238, and a portion of the edge 236. After separating the pattern 230 from the garment blank 226, a sleeve (not illustrated) is formed in a manner similar to the formation of the sleeve 123 or the sleeve 123A and secured to a gown body (not shown) in a manner similar to securing the sleeves 214 and 216 to the gown body 212.

Figure 12:
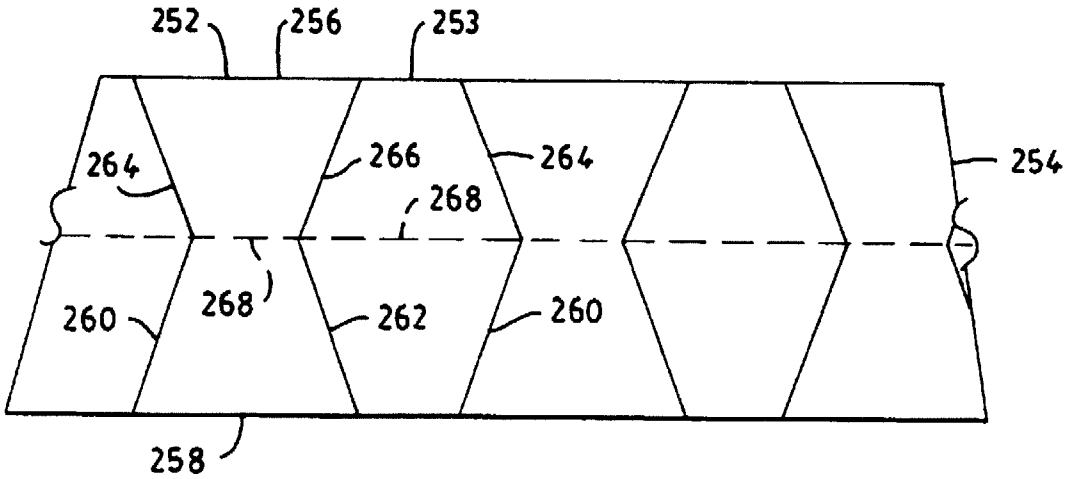
FIG. 12 is a plan view of a garment blank illustrating a repetitive pattern for a dual-layered set-in sleeve.

FIGS. 12–15 illustrate the formation of a dual-layered set-in sleeve 250. The sleeve 250 (FIGS. 14 and 15) may be formed from either pattern 252 or 253. The patterns 252 and 253 are illustrated in FIG. 12 in an alternating sequence on a garment blank 254. Both patterns 252 and 253 are six-sided. These sides include a pair of generally parallel edges, 256 and 258, and two pairs of non-parallel edges, 260/262 and 264/266. The edges, 260/262 and 264/266 of the pattern 252 converge from their respective parallel edges, 256 and 258, towards a fold line or edge 268. The edges, 260/262 and 264/266, of the pattern 253 diverge from their respective parallel edges, 256 and 258, toward the center fold line 268.

Figure 13:
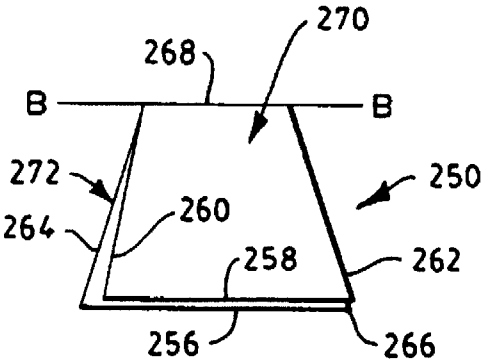
FIG. 13 is a plan view of a partially formed dual-layered sleeve according to the pattern of FIG. 12 folded along lines B—B.

Referring now to FIG. 13, a pair of integral triangular-shaped sleeve layers 270 and 272 are formed by removing a portion of the garment blank 254 defined by the pattern 252 and folding said portion along line B—B about the edge 268. The sleeve layer 270 is generally a mirror image of the sleeve layer 272. Both sleeve layers, 270 and 272, extend the length of the sleeve 250. The sleeve layer 270 is defined by edges 268, 260, 258 and 262. The sleeve layer 272 is defined by edges 268, 264, 256 and 266.

By folding the removed portion of the garment blank as described above, three pairs of contiguous edges, 260/264, 258/256 and 262/266, are formed. Two of the three pairs of contiguous edges, 260/264 and 262/266, are opposed contiguous edge pairs, as these edge pairs are positioned on opposite sides of the folded portion of the garment blank 254 defined by the pattern 252.

Figure 14:
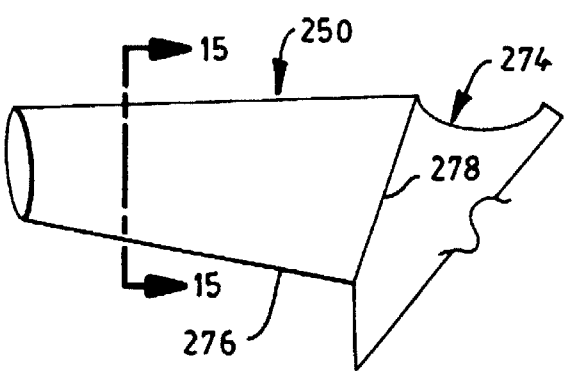
FIG. 14 is a plan view of the dual-layered sleeve of FIG. 13 attached to a partially illustrated gown body.
Figure 15:
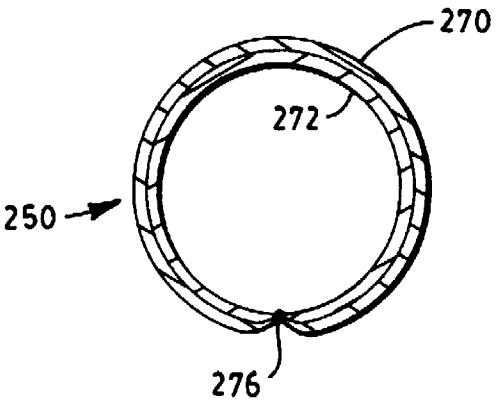
FIG. 15 is a cross-sectional view of the dual-layered sleeve of FIG. 14 along lines 15—15.

FIG. 14 illustrates the attachment of the sleeve 250 to a partially illustrated gown body 274. The sleeve 250 is formed by gathering together contiguous edge pairs 264/260 and 262/266 and then bonding them together. The bonded edges form a bottom sleeve seam 276 (FIG. 15). The contiguous edge pair 256/258 is gathered and bonded to the edges of the gown body 274 defining a sleeve opening 278. It will be understood that while edges 256 and 258 of the sleeve 250 resulting from the pattern 252 are attached to the gown body 274 about the sleeve opening 278, these same edges 256 and 258 of the pattern 253 may be attached to a cuff (not shown). FIG. 15 more clearly illustrates in cross-section the orientation of the sleeve layers 270 and 272 of the sleeve 250 and the bottom seam 276.

Figure 16:
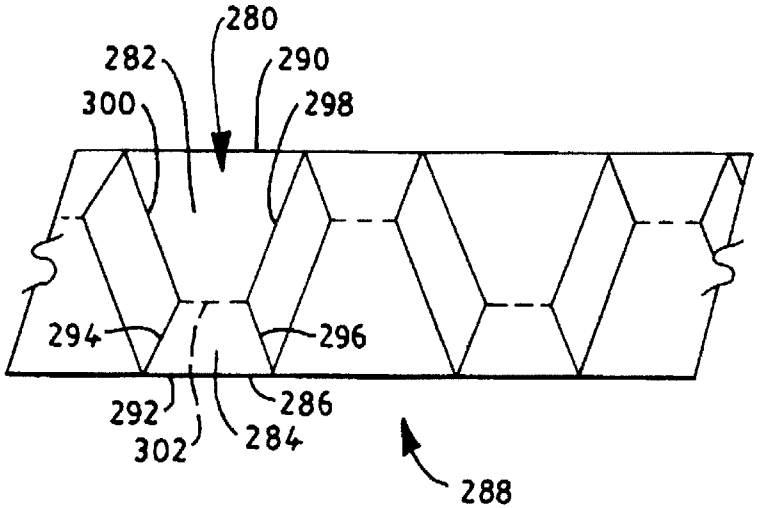
FIG. 16 is a plan view of a garment blank illustrating a repetitive pattern for a set-in sleeve having a reinforcing layer.
Figure 18:
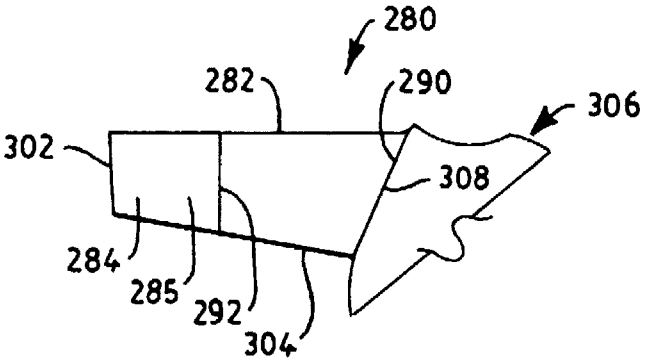
FIG. 18 is a plan view of the sleeve of FIG. 17 attached to a partially illustrated gown body.
Figure 17:
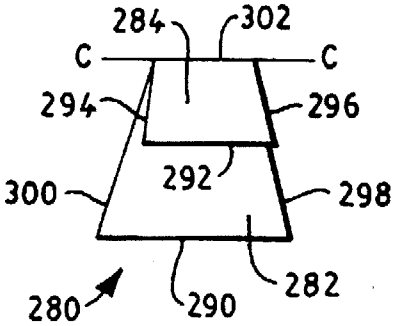
FIG. 17 is a plan view of a partially formed sleeve according to the pattern of FIG. 16 folded along lines C—C.

FIGS. 16–18 illustrate the formation of a sleeve 280. The sleeve 280 includes a trapezoid-shaped sleeve layer 282 integral with a trapezoid-shaped reinforcing layer 284. A pattern 286 is illustrated in FIG. 16 in an alternating sequence on a garment blank 288. The pattern 286 is six-sided. These sides include a pair of generally parallel edges 290 and 292 and two pairs of non-parallel edges, 294/296 and 298/300. The side edges 294/296 and 298/300 converge from their respective parallel edges, 290 and 292, toward a fold line or edge 302.

Referring now to FIGS. 17 and 18, the sleeve 280 is formed by removing a portion of the garment blank 288 defined by the pattern 286. The removed material is folded along line C—C about the edge 302. In this way, the sleeve layer 282 is defined by the edges 302, 300, 290 and 298 and the reinforcing layer 284 is defined by edges 302, 294, 292 and 296. By folding the removed material as described above, two pairs of opposed, contiguous edges, 300/294 and 298/296, are formed. A bottom sleeve seam 304 is formed by bonding the contiguous edge pairs 300/294 and 298/296, and the edges 300 and 298. The edge 290 is bonded to an edge 308 of a partially illustrated gown body 386. As is most clearly shown in FIG. 18, the reinforcing layer 284 is sized to completely overlie a portion of the sleeve layer 282 from the edge 302, which generally corresponds to the location of a wearer's wrist (not shown), to about half way between edge. 302 and the sleeve opening 308, which generally corresponds to the location of the wearer's elbow (not shown). In this way, a reinforcing area 285 is defined by the juxtaposition of a portion of the sleeve layer 282 with the reinforcing layer 284. It will be understood that the size of the reinforcing area 285 may vary by varying the size of the reinforcing layer 284. As illustrated in FIG. 18, the reinforcing area 285 is sized to encircle a wearer's forearm from the wrist to the elbow.

Figure 19A:
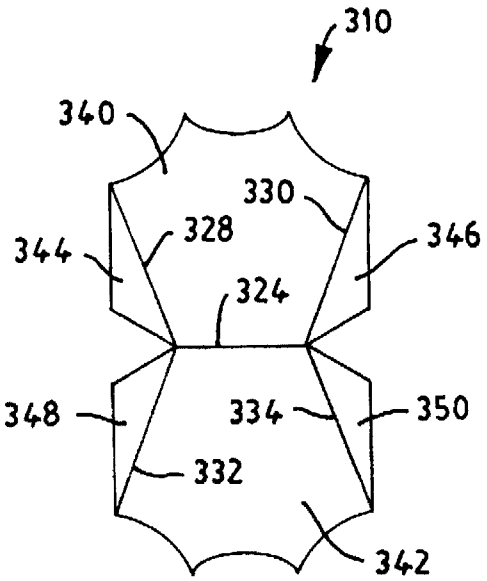
FIG. 19 is a plan view of a garment blank illustrating a repetitive pattern for a dual-layered raglan sleeve having integral sleeve and reinforcing layers.
Figure 19:
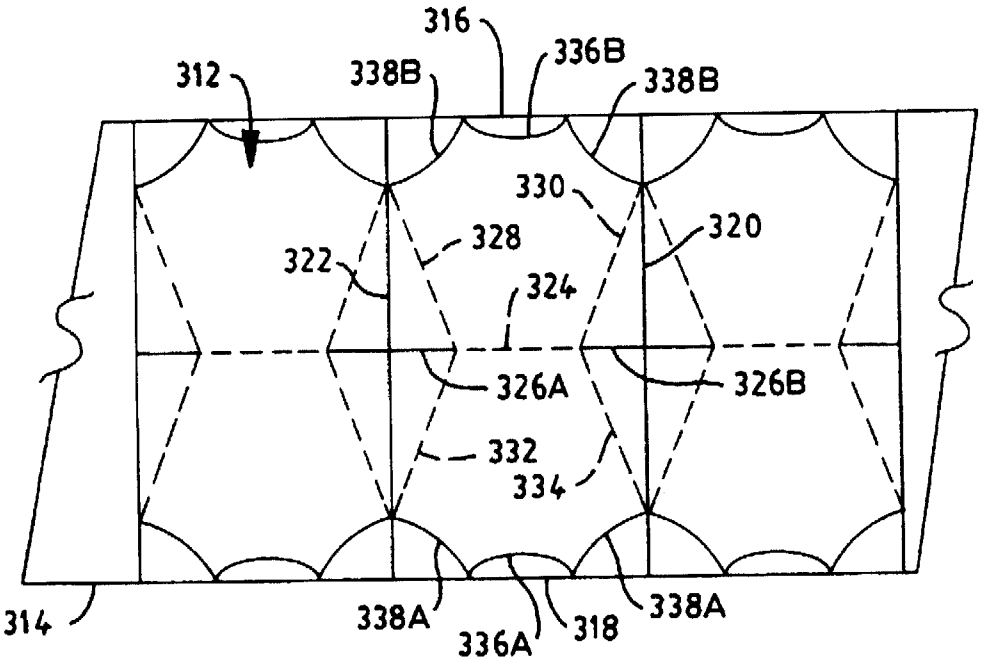
Figure 20:
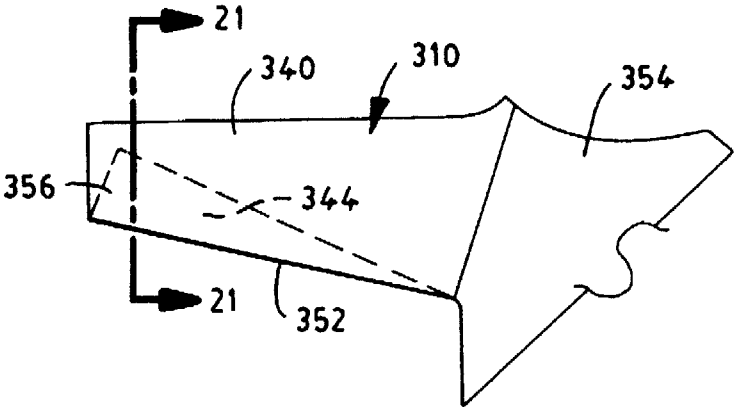
FIG. 20 is a plan view of the dual-layered sleeve formed according to the pattern of FIG. 19 and attached to a partially illustrated gown body.
Figure 21:
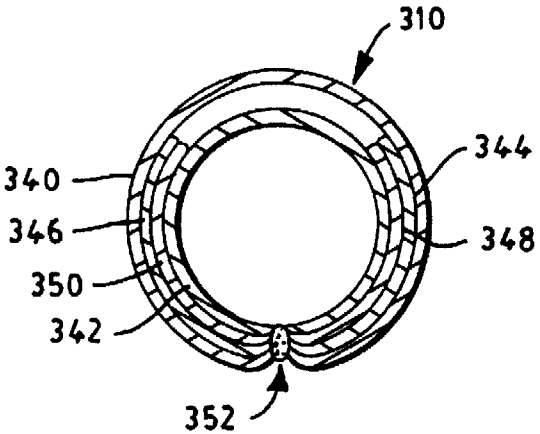
FIG. 21 is a cross-sectional view of the dual-layered sleeve of FIG. 20 taken along lines 21—21.

FIGS. 19–21 illustrate the formation of a dual-layered, reinforced raglan sleeve 310. The sleeve 310 may be formed from a pattern 312 which is illustrated in repeating units on a garment blank 314 (FIG. 19). The pattern 312 is generally rectangular-shaped and defined by edges 316, 318, 320 and 322. The pattern 312 also includes a fold line, or edge 324, a pair of cut-lines 326A and 326B, two pairs of fold lines or edges 328/330 and 332/334, and a pair of neck and sleeve cutouts 336A and 338B.

Referring now to FIG. 19A, the sleeve 310, which includes a pair of sleeve layers 340 and 342 integrally united along the edge 324, is formed by removing a portion of the garment blank 314 defined by the pattern 312. Integral with the sleeve layer 340 is a pair of triangular-shaped reinforcing layers 344 and 346. The edges 328 and 330 unite the reinforcing layer 344 with the sleeve layer 340 and the reinforcing layer 346 with the sleeve layer 340, respectively. Integral with the sleeve layer 342 is another pair of triangular-shaped reinforcing layers 348 and 350. The common edges 332 and 334 integrally unite the sleeve layer 342 with the reinforcing layer 348 and the sleeve layer 342 with the reinforcing layer 350, respectively.

Figure 19B:
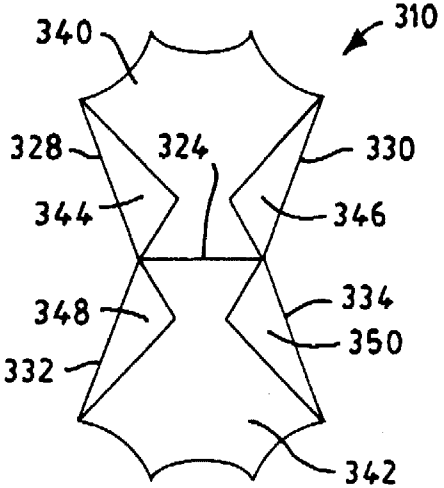

Referring now to FIGS. 19B, 20 and 21, each pair of reinforcing layers, 344/346 and 348/350 is folded inwardly and secured to the respective surfaces of sleeve layers 340 and 342. The sleeve layers 340 and 342 are folded about the edge 324 so as to capture therebetween the reinforcing layer pairs, 344/346 and 348/350 (FIG. 21). In this way, two pairs of contiguous edges are formed wherein the pairs of contiguous edges is opposed. The first pair of contiguous edges is 328/332 and the second pair of contiguous edges are 330/334. The edge pairs 328/332 and 330/334 are gathered and bonded so as to form a bottom seam 352. The sleeve 310 may include a cuff (not shown) and may be attached to a gown body 354 as previously described. A reinforcing area 356 defined by the reinforcing layer pairs, 344/346 and 348/350 is similar to the reinforcing area of sleeves 214 and 216 except that the reinforcing area 356 is formed by two juxtaposed reinforcing layers.

It is further noted that the present invention may be made from a multitude of materials including nonwoven materials suitable for disposable use. For example, the gown may be made of stretchable nonwoven material so that the gown is less likely to tear during the donning or wearing of the gown. A material well-suited for use with the present invention is a three-layer nonwoven polypropylene material known as SMS. SMS is an acronym for Spunbond, Meltblown, Spunbond, the process by which the three layers are constructed and then laminated together. See for example, U.S. Pat. No. 4,041,203 to Brock et al. One particular advantage is that the SMS material exhibits enhanced fluid barrier characteristics. It should be noted, however, that other nonwovens as well as other materials including wovens, films, foam/film laminates and combinations thereof may be used to construct the gown of the present invention. It is also contemplated that the gown may be coated with a liquid impervious coating to prevent fluid absorption into the gown material.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

What is claimed is:

1. A gown sleeve comprising:

a single piece of material folded upon itself to form at least two integral layers bounded by at least two fold lines, said fold lines being attached to form a seam;

wherein one of the layers forms the sleeve and another layer forms an overlapping reinforcing layer adapted to substantially encircle at least a portion of a wearer's forearm.

2. The sleeve of claim 1, wherein the reinforcing layer is attached to the sleeve forming layer.

3. The sleeve of claim 1, wherein the reinforcing layer has a thickness of at least two layers.

4. The sleeve of claim 1, wherein the reinforcing layer extends substantially the length of the sleeve.

5. A gown comprising:

a body integral with a sleeve;

wherein the sleeve comprises a single piece of material folded upon itself to form at least two integral layers bounded by at least two fold lines, said fold lines being attached to form a seam;

wherein one of the layers forms the sleeve and another layer forms an overlapping reinforcing layer adapted to substantially encircle at least a portion of a wearer's forearm.

6. The gown of claim 5, wherein the reinforcing layer is attached to the sleeve forming layer.

7. The gown of claim 5, wherein the reinforcing layer has a thickness of at least two layers.

8. The gown of claim 5, wherein the reinforcing layer extends substantially the length of the sleeve.

9. A method of making a sleeve comprising the steps of:

folding a portion of a section of material upon itself to form a fold line and an overlapping layer;

folding another portion of the section of material upon itself to form another fold line and another overlapping layer; and joining the fold lines together to form a seam, wherein the overlapping layer is a reinforcing layer adapted to substantially encircle at least a portion of a wearer's forearm.

10. The method of claim 9, wherein the reinforcing layer extends the length of the sleeve.

11. The method of claim 9, wherein the section of material is first folded upon itself at a fold line to form overlapping trapezoid-shaped layers.

12. The method of claim 9, further including the step of securing the overlapping layers to the section of material.

* * * * *